US005147273A

United States Patent [19]

Rottmann et al.

[11] Patent Number: 5,147,273

[45] Date of Patent: Sep. 15, 1992

[54] METHOD AND APPARATUS FOR PRODUCING STACKS OF INTERLEAVED MATERIAL SHEETS

[75] Inventors: Engelbert Rottmann, Andernach; Gilbert Hauschild, Neuwied; Christian Riedel, Dormagen, all of Fed. Rep. of Germany

[73] Assignee: Winkler & Duennebier Maschinenfabrik KG, und Eisengiesserer KG Sohler, Fed. Rep. of Germany

[21] Appl. No.: 551,439

[22] Filed: Jul. 10, 1990

[30] Foreign Application Priority Data

Jul. 15, 1989 [DE] Fed. Rep. of Germany ..... 3923436

[51] Int. Cl.[5] ..... B31F 1/00; B65H 45/00

[52] U.S. Cl. ..... 493/349; 493/388; 493/418; 493/430; 493/433; 270/39

[58] Field of Search ..... 493/349, 386, 388, 418, 493/422, 424, 425, 426, 427, 428, 429, 430, 431, 432, 433, 434, 435; 270/39, 40

[56] References Cited

U.S. PATENT DOCUMENTS

| | | | |
|---|---|---|---|
| 843,781 | 2/1907 | Wheeler | 493/418 |
| 1,053,914 | 2/1913 | Hudson | 493/418 |
| 1,561,908 | 11/1925 | Cannard et al. | 493/428 |
| 1,761,517 | 6/1930 | Christman . | |
| 1,966,885 | 7/1934 | Crafts | 493/424 |
| 2,092,952 | 9/1937 | Campbell | 270/39 |
| 2,872,186 | 2/1959 | Raybuck | 493/418 |
| 3,363,896 | 1/1968 | McKindary | 493/418 |
| 3,490,762 | 1/1970 | Nystrand | 270/39 |
| 3,572,681 | 3/1971 | Nystrand | 493/433 |
| 4,070,014 | 1/1978 | Takahashi | 493/433 |
| 4,270,744 | 6/1981 | Trogan . | |
| 4,332,582 | 6/1982 | Hertrich | 493/424 |
| 4,494,741 | 1/1985 | Fischer et al. | 83/100 |
| 4,691,908 | 9/1987 | Bradley | 493/360 |
| 4,765,604 | 8/1988 | Trogan | 493/371 |
| 4,778,441 | 10/1988 | Couturier | 493/425 |
| 4,824,426 | 4/1989 | De Fresne | 493/418 |
| 4,917,665 | 4/1990 | Couturier | 493/475 |

FOREIGN PATENT DOCUMENTS

| | | | |
|---|---|---|---|
| 330561 | 7/1976 | Austria . | |
| 178663 | 11/1906 | Fed. Rep. of Germany . | |
| 636666 | 10/1936 | Fed. Rep. of Germany . | |
| 1804082 | 10/1969 | Fed. Rep. of Germany . | |
| 2436662 | 2/1975 | Fed. Rep. of Germany . | |
| 2533434 | 10/1977 | Fed. Rep. of Germany . | |
| 0234281 | 9/1987 | Fed. Rep. of Germany . | |
| 3708016 | 9/1988 | Fed. Rep. of Germany . | |
| 1479299 | 7/1977 | United Kingdom . | |
| 2066783 | 12/1980 | United Kingdom | 493/425 |

*Primary Examiner*—Bruce M. Kisliuk
*Assistant Examiner*—John A. Marlott

[57] ABSTRACT

A method and an apparatus produce a stack of overlapping, U-folded- or zig-zag-folded individual material sheets, in particular of absorbent paper, that mesh with one another. The stack is formed by two roller systems or roller sets, one for each of two material webs. Each system includes a stacking roller (8, 9) in a stacking station. The two stacking rollers cooperate in the stack formation. Each set of rollers includes at least one cutting roller (11) with a cutting knife (12) for each material web, a transport roller (13), and a pulling and guide roller (14). All rollers are arranged and driven in a machine frame. Each stacking roller (8,9) has at least one crimping- and folding-edge (16,20,21) and at least one tiltable suction gripper flap. At least one suction element (23) is part of the suction gripper flap and at least one further suction element (24) is arranged behind the suction gripper flap or behind the crimping- and folding-edge as viewed in the sheet travel direction.

10 Claims, 5 Drawing Sheets

METHOD AND APPARATUS FOR PRODUCING STACKS OF INTERLEAVED MATERIAL SHEETS

FIELD OF THE INVENTION

The invention relates to a method and an apparatus for producing a stack of overlapping, U-folded or zig-zag-folded individual material sheets, e.g. of paper or cloth, in particular of absorbent paper. The folded sheets mesh with one another.

BACKGROUND INFORMATION

Folding machines for the above purpose are known, wherein the folding is accomplished with the help of two roller systems, one for each of two material or fabric webs. Two cooperating stacking rollers are arranged at a stacking station where the stack is to be formed during the folding process. Transport rollers and at least one cutting roller with a cutting knife are provided for each material web. Pulling rollers and guide rollers are also provided. All rollers are arranged and driven either directly or indirectly in a machine frame.

Two prepared material webs formed as an uninterrupted flow of material pieces of equal lengths that are separated or perforated from one another, are guided together and folded in a zig-zag manner or U-shaped manner. Thereby, web pieces are suitably displaced relative to one another by one half of a piece length, so that after the folding, a piece end of one piece and a piece beginning of the neighboring piece of one material web lie in the fold of the piece of the other material web.

The known machines use suction rollers as folding rollers. These suction rollers cannot produce precise fold edges, but with their help, the material pieces that are in a sequence of separated individual material pieces, can be exactly deposited on a stack, whereby folded edges are formed by pressure in the stack. A disadvantage of this operation is the relatively imprecise formation of the folding edge, the rather large stack height, and few possibilities to detect production mistakes immediately.

Other devices for producing stacks of folded and zig-zag meshed material sheets have delivery or stacking rollers with folding flaps. These folding flaps grip the material web and produce a fold edge. However, the components of the folding flaps or blades that are involved in this gripping can securely hold only one single material layer while making a fold. As a result, especially, the inner layer of the zig-zag-layered stack cannot be securely held. While the secure and good delivery of one material web can be guaranteed, the proper handling of the second material web is not assured. Therefore, such apparatus can only process endless and perforated material webs, but not material webs formed by a sequence of separated individual sheets. This conventional limit is especially applicable, where the individual sheets must have a minimum spacing of 5 mm due to technical manufacturing reasons.

OBJECTS OF THE INVENTION

In view of the foregoing it is the aim of the invention to achieve the following objects singly or in combination:

- to provide a method and an apparatus for the secure and precise fold formation;

- to assure a precise delivery of folded individual sheets in alternating, meshing stacks, the foregoing must also be possible when the individual sheets have a minimum spacing from each other during the processing;
- to assure a proper gripping of the individual material sheets; and
- to obtain a proper fold formation even at high operational speeds.

SUMMARY OF THE INVENTION

According to the invention, each folding roller comprises at least one crimp-forming folding blade edge and at least one movable gripping element, and at least one suction element arranged on or at the gripping element and one suction element arranged next to the gripping element at the circumference of the stacking roller.

The movable gripping element is arranged in a recess that opens toward the circumference of the stacking roller. The gripping element together with a rigid edge of the stacking roller form a gripping gap, whereby the rigid edge may be leading or trailing relative to the movable gripping element relative to the rotational direction of the stacking roller. The gripping gap and the suction elements arranged directly in front of or behind of and on the gripping element or at the rigid edge, are so constructed that the individual sheet to be folded or crimped and the ends of both neighboring sheets that lie within the first mentioned sheet, can be securely and reliably gripped. Through the use of the suction elements, this feature is assured even when the ends of the sheets lying within the sheet being folded have a minimum spacing from each other during processing.

The individual sheets are gripped, when the crimp- or folding-edge on the respective other delivery roller has pushed an individual sheet into the gripping gap and the suction elements have fixed the exact position of the individual sheet to be crimped and folded and the exact position of the ends of the neighboring sheets that lie within said sheet. Since these features assure a good folding, guiding and a secure delivery of the individual sheets, processing can also take place at high speeds.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
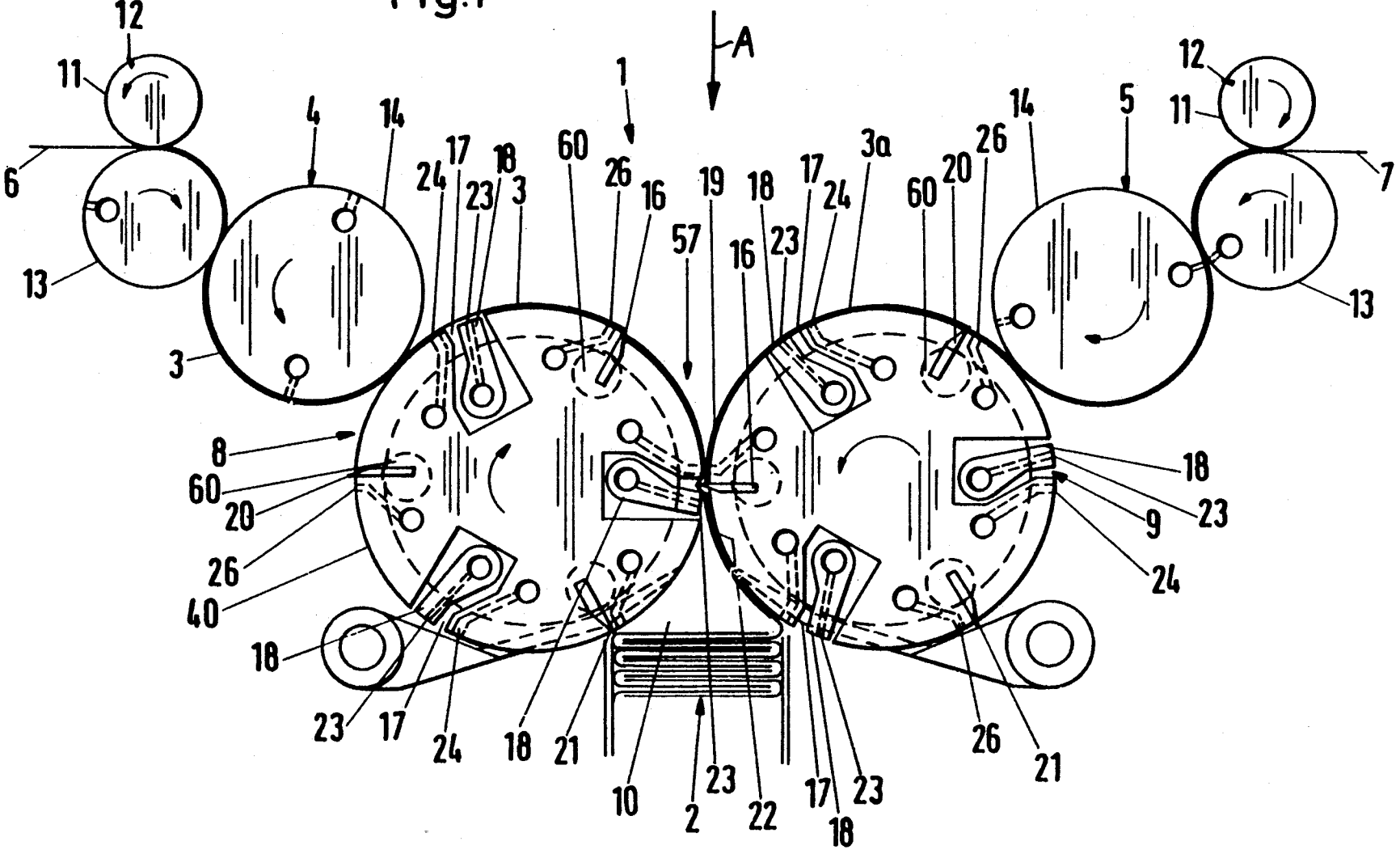
FIG. 1 is a principle simplified side view of the roller sets for both of the material webs in the region of the stacking station.
Figure 3:
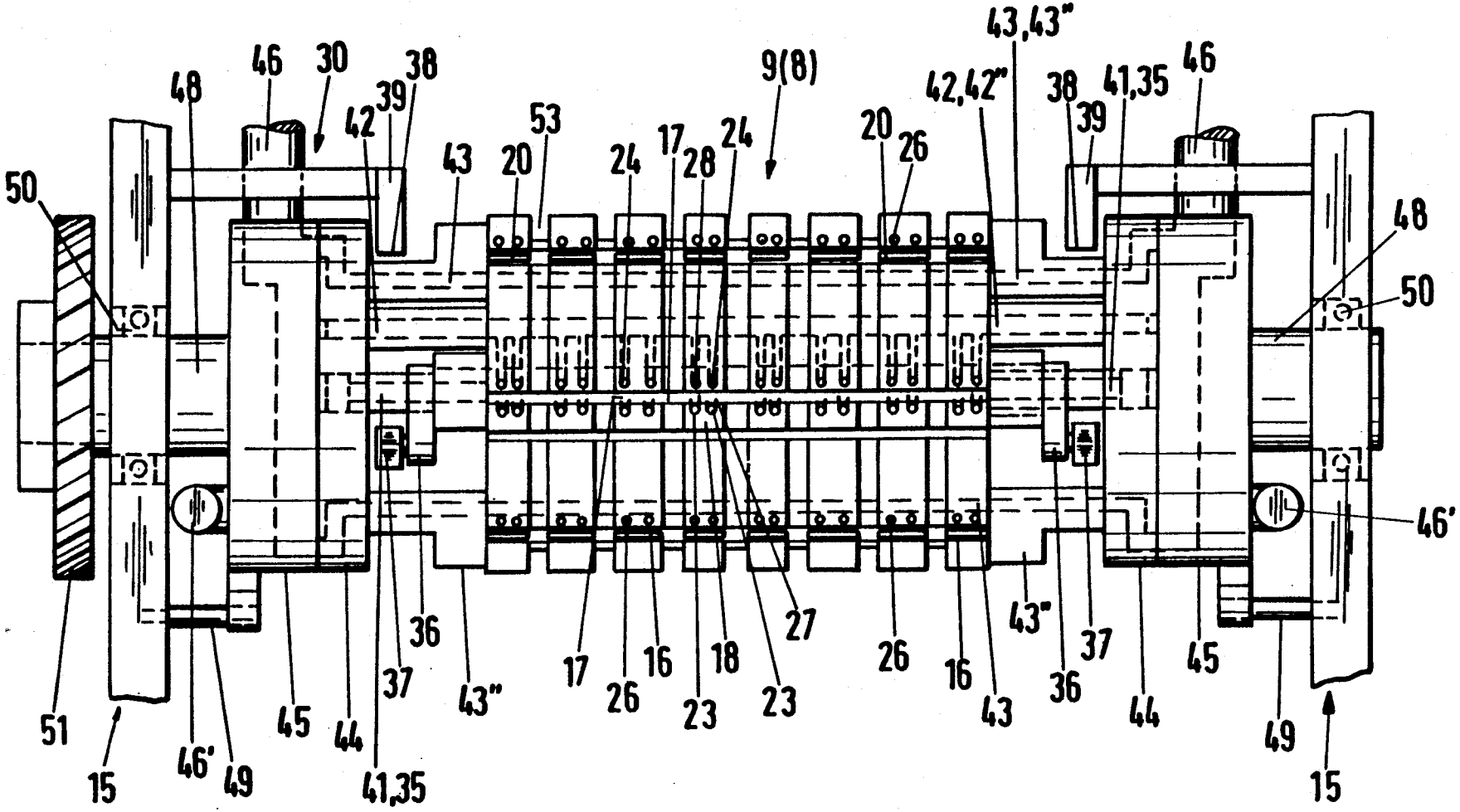
FIG. 3 is a top view of the apparatus as viewed in the direction of the arrow A in FIG. 1.

The apparatus 1 for forming a U-folded- or zig-zag-folded stack 2 of overlapping or meshing folded individual material sheets 3, comprises according to FIG. 1, two roller systems 4, 5. Each roller system handles one material web 6 or 7 with the aid of one delivery roller 8, 9 directly at the stacking station 10 to assist in the stacking process. The stacking rollers are positively driven as is conventional. In addition to the stacking roller 8, 9, each roller system 4, 5 comprises at least one cutting roller 11 with a cutting knife 12 and transport rollers, delivery rollers and/or guide or detour rollers 13, 14. All of the rollers are supported in a machine frame 15 (FIG. 3). The direction of rotation of the rollers is indicated by the arrows in FIG. 1. The transport rollers are positively driven as is conventional.

The U-folding or deposition or a zig-zag-folding or deposition of the individual sheets 3 and the meshing insertion of the next individual sheet 3 between the section or halves of the individual sheet 3 that is to be folded, is achieved by both of the stacking rollers 8, 9. For this purpose, one of the stacking rollers 8 or 9 has crimp- and folding-edges 16, while the other stacking roller 9 or 8 has initially open gripping gaps 17 and gripping elements 18 formed as suction gripper flaps to be described in more detail below. During operation, the endless material webs 6, 7 are first cut into individual sheets 3, 3*a*, see also FIG. 2, by the cutting knife 12 of the cutting roller 11. After cutting the individual sheets 3, 3*a* are slightly spaced from one another, for example up to 5 mm apart. The sheet spacing depends conventionally on a respective roller speed selection. The sheets are then guided toward the stacking roller 8 or 9, so that one individual sheet 3 that is transported by the stacking roller 8 to the stacking station 10 is off-set by half a sheet length or a partial sheet length from the other individual sheet 3*a* that is guided and transported by the other stacking roller 9. The leading edge 19 of the individual sheet 3*a* meets the middle of the other individual sheet 3 at the roller gap 57 of the two stacking rollers 8, 9 provided the individual sheet has a fold. If the individual sheet 3 has two or more opposing crimps or folds, the leading edge 19 of the individual sheet 3*a* also contacts a crimp or fold of the other individual sheet at the roller gap 57. Thus, the individual sheet 3*a* extends on the stacking roller 9 and the individual sheet 3 extends on the stacking roller 8, in the respective working position, from one crimp- or folding-edge 16 to the next trailing crimp- and folding-edge 20, as viewed in the circumferential direction, whereby the rotational direction of the respective stacking roller 8, 9 determines the movement direction of the sheets.

The gripping gap 17 and the gripper flap 18 are arranged on the stacking rollers 8 and 9 half way between two crimp- and folding-edges 16 and 20, or 16 and 21, or 20 and 21. Thus, during crimping or folding, an individual sheet 3 on the stacking roller 8 in the position of FIG. 1, is pressed into the gripping gap 17 of the stacking roller 8 by the crimp- and folding-edge 16 of the stacking roller 9, whereby the individual sheet 3 is temporarily fixed in its position by the gripper flap 18. Simultaneously, the individual sheet 3 is centrally gripped on the stacking roller 8 while the sheet is being crimped and folded. Further, the leading end 19 of the next individual sheet 3*a*, that is being transported to the stacking station 10 by the stacking roller 9 and the trailing end 22 of the last individual sheet 3 that has been delivered, are held by the suction elements 23, 24, to be explained below. These suction elements are 23, 24 are effective through the folded individual sheet 3 because these sheets are not airtight. As the stacking roller 8 keeps rotating toward the stack 2, the suction elements 23, 24 release the leading end 19 of the individual sheet 3*a* and the trailing end 22 of the last delivered individual sheet 3. When the gripping gap 17 and the suction gripper flap 18 reach the upper left edge of the stack 2, the gripper flap 18 releases the centrally held individual sheet 3. In the meantime, the crimp- and folding-edge 16 is in a position on the stacking roller 8 in an area of the narrowest point of the roller gap 57 and presses the individual sheet 3*a* into the gripping gap 17, whereupon the gripping gap is closed by the pivoting of the gripper flap 18. The stacking roller 9 follows the same operating cycle as described and releases the individual sheet 3*a* as soon as the gripper flap 18 reaches the upper right end of the stack 2. The crimping and folding and the depositing in the stack 2 follow in essentially the same fashion for all further individual sheets 3 and 3*a* that are being transported to the stacking area 10.

For guiding and insuring a secure transport of the individual sheets 3, 3*a*, at least one suction element 23 in the form of a suction bore is arranged inside the gripper flap 18 and another suction element 24 is located directly next to the gripper flap 18 near or at the circumference of the stacking rollers 8, 9. A third suction element 26 is located directly next to and in the operating direction of the stacking roller 8, 9 behind each crimping and folding-edge 16, 20 and 21. All of the suction elements 23, 24 and 26 comprise suction openings in the contour of the stacking rollers 8, 9 to which individual, separately controllable suction bores are connected. Suction bore 27 is located in the gripper flap 18 and suction bores 28 and 29 are located in the stacking rollers 8, 9. Through a suction intake control valve 30 (FIGS. 3 to 5), suction or reduced pressure is produced or released in a synchronous manner in the suction bores 27, 28, 29 of the two stacking rollers 8, 9, so that the individual sheets 3 and 3*a* are deposited in the correct manner in the stack 2. This manner of suction control is known as such and therefore not part of the invention.

The suction gripper flap 18 is arranged in a recess 31 that opens toward the circumference 25 of respective stacking roller 8, 9. Flap 18 is tiltably mounted an a journal pin 35 and has the shape of a gripper or clamping flap having a clamping piece 32 with a clamping surface 33 at its free end. The clamping surfaces 33 are arranged on the trailing side of the clamping pieces 32, as viewed relative to the movement direction of the sheet. In order for the gripper flaps 18 to function properly, an opposing surface in the form of a contact surface 34 rigidly connected to or forming parts of the stacking roller 8, 9, is provided for each clamping surface 33. When the gripper flap 18 is open, the gripping gap 17 is located between the clamping piece 32 or rather its clamping surface 33 and the contact surface 34 of the stacking roller 8, 9.

Figure 2:
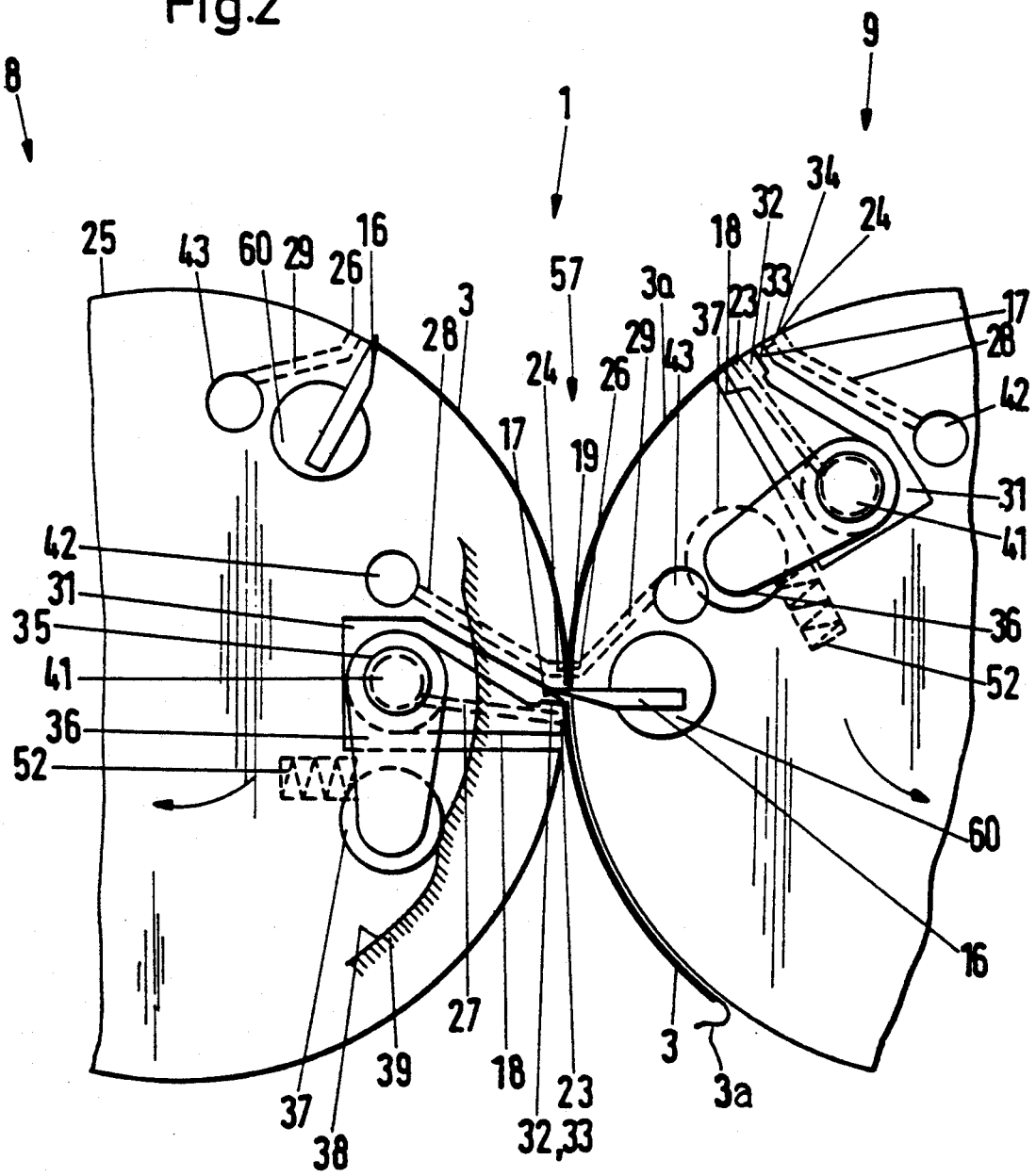
FIG. 2 is a partial enlarged view, compared to FIG. 1 of both stacking rollers in the region of the stacking station.

As seen in FIG. 2, the gripper flap 18 is arranged on the tilting or journal pin 35 having a control lever 36 for controlling the tilting or journalling of the respective flap. The control lever 36 carries a guide pulley 37. A stationary control cam 38 is provided to assist in the control of the tilting or journalling of the gripper flap 18. The cam 38 is mounted to or part of a cam carrier 39 that is connected outside the stacking rollers 8, 9, see FIG. 3.

As the figures further show, each suction bore 27 runs from the suction opening in the shell or jacket 40 of each stacking roller 8, 9 through the respective gripper flap 18 and its tilting or journal pin 35 to the suction intake control valve 30. For this purpose a borehole 41 is provided in each tilting or journal axis pin 35. The other suction bores 28 and 29 are connected to the suction intake control valve 30 or rather, to its rotating control cam plate 44 through further boreholes 42 and 43. Inside the control cam plate 44, the boreholes 41, 42 and 43 have an air-conducting connection to their respective control windows 41', 42', and 43'. The boreholes 42 and 43 run between the roller body proper and the control cam plate 44 through their respective extension pieces 42" and 43".

Next to the rotating control cam plate 44, the suction intake control valve 30 has a stationary control cam plate 45 having suction intake control channels 47, 58 and 59 and channels 47' and 58' for the atmospheric equalization of pressure. The suction intake control channels 47, 58 and 59 are connected by means of suction connectors 46 and 46' to a suction source not shown in the drawings. While the control cam plate 44 rotates, both control cam plates 44 and 45 cause the synchronous generation and suspension of suction, whereby the control windows 41', 42' and 43' move past the control canals 47 and 47', or 58, 58', and 59, 58'.

Figure 4:
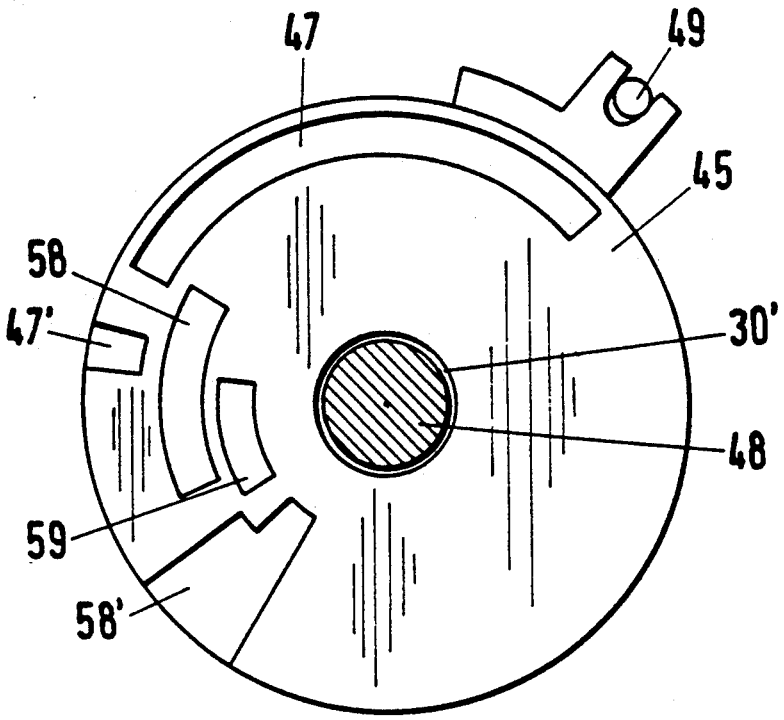
FIG. 4 is a view of a stationary control cam plate of the suction intake control valve in the direction of arrows IV—IV of FIG. 3.
Figure 5:
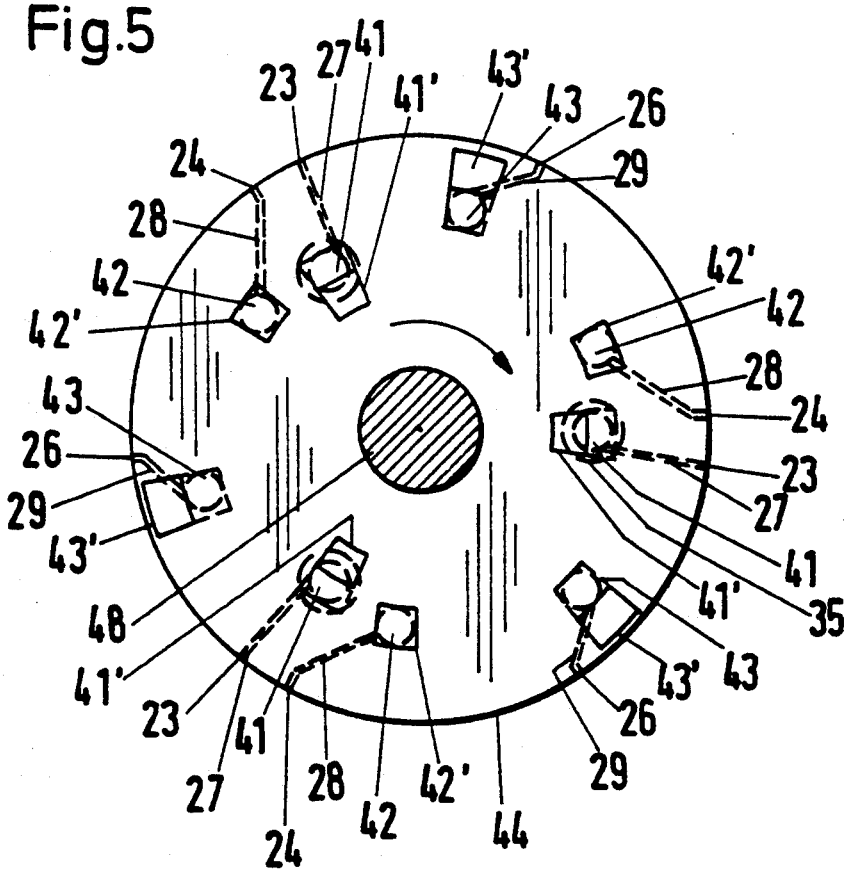
FIG. 5 is a view of a rotating control cam plate in the direction of the arrows V—V of FIG. 3.

The suction intake control valve 30 shown in FIG. 3 is mounted concentrically by means of a bearing 30' shown in FIG. 4 to the driving and bearing shaft 48 of the stacking roller 8, 9. The control valve 30 is fastened by a bolt 49 to the machine frame 15 so that it is fixed against the rotation as shown in FIG. 3. Ball bearings 50 support the driving and bearing shaft 48 in the machine frame 15 and a gear wheel 51 is provided for driving the shaft 48, as also shown in FIG. 3.

A spring 52 biases the pivot and control lever 36 of the gripping element 18, thereby holding the suction gripper flap 18 in the locked position. The control cam plate 38 opens the suction gripper flap 18. When the flap 18 of the stacking roller 8 or 9 and the crimping and folding-edge 16 of the respective other delivery roller 8 or 9 are located at the roller gap, or rather at the narrowest point of the roller gap 57, as shown in FIG. 2, the control cam plate 38 pivots, by means of the guide roller 37 and the control lever 36, the flap 18 and its clamping piece 32 into the opened position. The roller gap 57 must be closed very rapidly after being opened. The part of the control cam plate 38 that causes the opening extends over only a relatively short arc in the area of the roller gap 57 and the lateral upper edge of the stack 2 as shown in FIG. 2.

According to FIG. 3, the stacking roller 8, 9 is supported substantially symmetrically in the machine frame 15. The same is true for the suction control, so that suitably one suction intake control valve 30 is located axially at each end of the stacking roller 8, 9.

The illustration of FIG. 3 has been somewhat simplified for a better overview. For example, control levers 36 and a guide roller 37 are not depicted on all of the tilting axes 35, although a control lever and guide roller is absolutely necessary on each of these axes.

Several suction gripper flaps 18 and crimping- and folding-edges 16 are axially arranged next to one another on the circumference 25 of the two stacking rollers 8 and 9. Between the flaps 18 and the folding edges 16 there are grooves or furrows 53, so that the stacking rollers 8, 9 have slightly comb-like surfaces. The gripping gap 17 extends radially. The same is true for the clamping surfaces 33 and the contact surfaces 34 of the stacking rollers 8, 9. The crimping- and folding-edges 16, 20, and 21 are mounted in the stacking rollers 8, 9 by means of elastic mounting supports 60.

In the example embodiment of FIGS. 1 and 2, a cut material web or rather, individual sheets 3, 3*a* are guided to each stacking roller 8 or 9. Therefore, a suction element 26 is needed in both stacking rollers 8 and 9, behind the crimping- and folding-edges.

Figure 6:
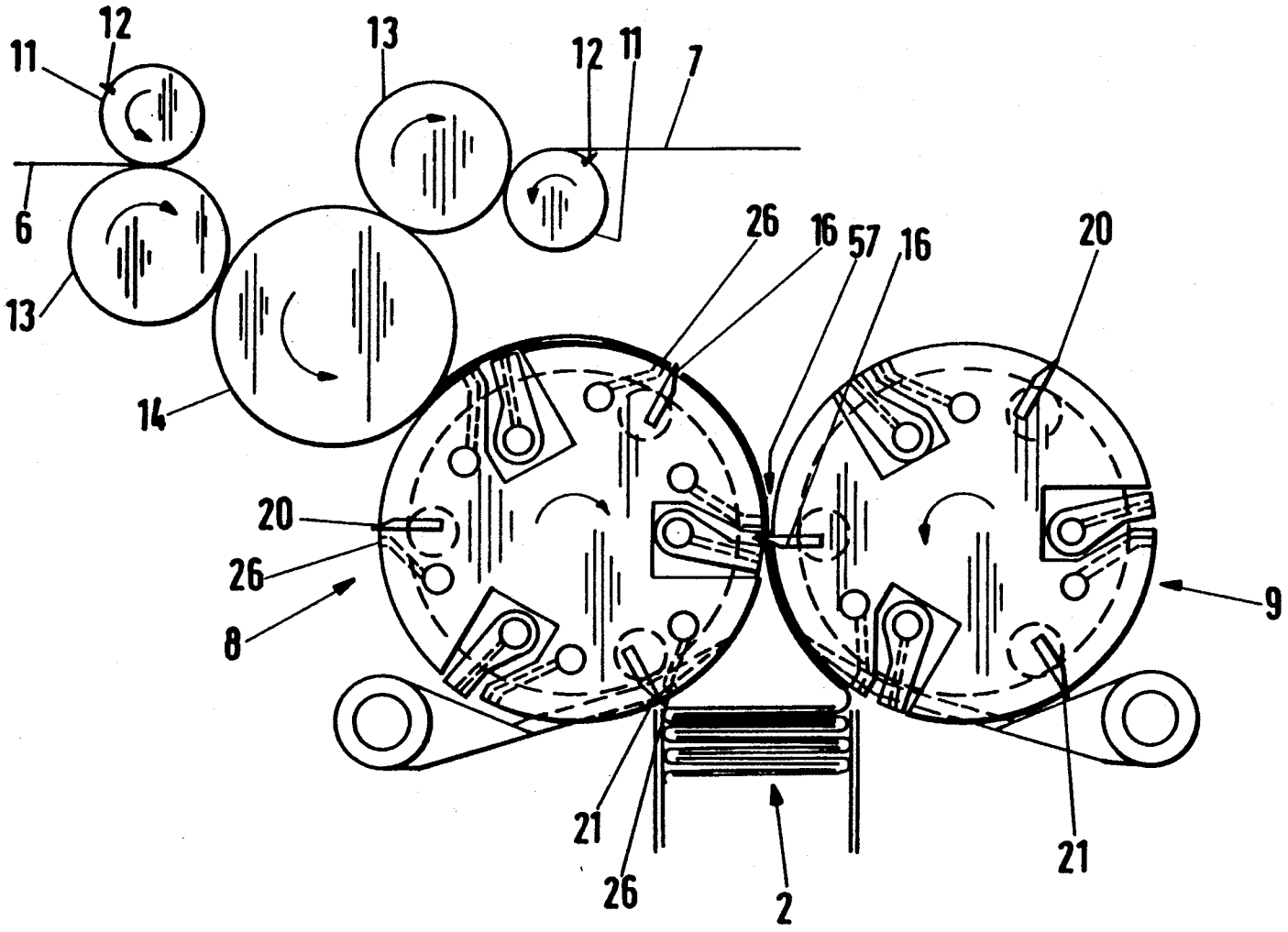
FIG. 6 is a principle simplified side view similar to that of FIG. 1, of a modified roller system, in which two prepared material webs are guided together onto one roller and then guided as a double web toward the stacking roller.

According to the example embodiment of FIG. 6, it is also possible that both prepared material webs 6 and 7, or their individual sheets, be guided together onto one roller 14 before reaching the stacking rollers 8, 9, thereby forming a double layered web of individual sheets or of perforated material webs. In this example, the double layered web is taken over by only one stacking roller 8 and guided toward the roller gap 57. Therefore, this one stacking roller 8 must be provided with suction elements 26 behind the crimping- and folding-edges 16, 20 and 21. It is not necessary for the other stacking roller 9 to have suction elements behind its crimping- and folding-edges 16, 20 and 21 in this case.

Both example embodiments operate according to the same procedure. The results of this procedure are that an individual sheet with a location to be folded and the ends of two other individual sheets lying at the same location, are pushed out of an original direction of movement by a lateral guide and then are fixed there by folding, whereby the ends of one individual sheet lie within the fold of the other individual sheet, and the individual sheets are fixed mechanically and by means of suction air.

Although the invention has been described with reference to specific embodiments, it will be appreciated, that it is intended to cover all modifications and equivalents within the scope of the appended claims.

What we claim is:

1. An apparatus for producing a stack of interleaved material sheets meshing with one another, comprising a stacking station, two co-operating stacking roller means (8, 9) arranged to form a stack of sheets (3; 3*a*) at said stacking station, roller means (11, 13, 14) for transporting and guiding material webs (3, 3*a*) to said stacking roller means (8, 9), said roller means comprising web cutting means (12) for cutting said material webs into individual sheets, each of said stacking roller means comprising crimping-and folding-edge means (16, 20, 21) for creasing and folding each individual sheet (3, 3*a*), sheet gripper means (18) mounted on each of said stacking roller means (8, 9) for rotation with said stacking roller means, said sheet gripper means holding a sheet temporarily, each sheet gripper means (18) comprising a journal pin (35) and a suction gripper flap (18) tiltably mounted with said journal pin (35) for journalling said suction gripper flap (18) in addition to rotation with said stacking roller means, and suction means (23, 24, 26) arranged at a circumference of each stacking roller means (8, 9), said suction means cooperating with said crimping- and folding-edge means (16, 20, 21) and with said gripper means (18) for a firm and positive handling of each sheet (3, 3*a*) to form said stack in which the sheets are interleaved in a U- or zig-zag-configuration, said suction means comprising at least one suction element (23) in each suction gripper flap of said sheet gripper means (18), whereby said first suction element (23) tilts back and forth with its suction gripper flap, at least one second suction element (24) in said stacking roller means (8, 9) behind the respective suction gripper flap of said gripper means for cooperation with said suction gripper flap (18), at least one third suction element (26) arranged on said stacking roller means (8, 9) for cooperation with its respective crimping- and folding-edge means, and means (37, 38, 39) for controlling a tilting movement of said suction gripper flap (18) between a sheet gripping position and a release position.

2. The apparatus of claim 1, wherein said stacking roller means comprises a recess in its circumferential surface zone, said recess opening approximately radially outwardly, said suction gripper flap being operatively arranged in said recess.

3. The apparatus of claim 2, wherein said suction gripper flap (18) has a clamping piece (32) with a clamping surface (33) at the free end of said suction gripper flap (18), and wherein said recess comprises a counter surface (34) arranged for cooperation with said clamping surface (33) of said suction gripper flap (18).

4. The apparatus of claim 3, wherein said at least one suction element (23) has a suction opening next to said clamping surface (33), and a suction bore (27) in said suction gripper flap leading to said suction opening, said suction opening ending substantially in a jacket surface of said folding roller means.

5. The apparatus of claim 2, wherein said second suction element (24) comprises a suction opening located behind said recess in which said suction gripper flap (18) is arranged, as viewed in the sheet travel direction, and wherein said third suction element (26) comprises a respective suction opening located behind said crimping and folding edge means, as viewed in the sheet travel direction, said suction means further comprising suction bores leading to each of said suction openings of said second and third suction elements.

6. The apparatus of claim 5, wherein said suction opening of said second suction element (24) is also located behind said suction gripper flap (18) as viewed in the sheet travel direction.

7. The apparatus of claim 1, wherein said journal pin of said suction gripper flap comprises a rotatable mounting shaft rigidly secured to said suction gripper flap and tiltably mounted in said stacking roller means, and wherein said control means comprise a control lever connected to said mounting shaft for tilting said suction gripper flap, and a stationary control cam arranged outside said stacking roller means, said control lever having a free end engaging said control cam for tilting said suction gripper flap.

8. The apparatus of claim 7, wherein said rotatable mounting shaft of said suction gripper flap comprises a longitudinal bore forming a suction air duct, said suction gripper flap comprising a suction bore communicating with said suction air duct for supplying suction to said suction gripper flap.

9. The apparatus of claim 1, wherein said roller means for transporting material webs comprise one set of rollers for each stacking roller means, each set of rollers comprising a cutting knife carrying roller (11), a transport roller (13) for advancing a sheet, and a roller (14) for pulling and/or guiding a sheet, and wherein said two stacking roller means with their respective roller set are driven so that cut material sheets arrive in said stacking station in a mutually displaced manner for forming said stack with said interleaved material sheets.

10. The apparatus of claim 1, wherein said roller means comprise two sets of rollers each including a cutting knife (12), carrying roller (11) and at least one transport and/or pulling roller (13), said roller means further including one detouring roller (14) cooperating with said two sets of rollers (11, 13) for placing one sheet in a partial overlap on top of the other sheet prior to transporting two sheets partially displaced relative to each other, to the respective stacking roller means for forming said stack.

* * * * *

UNITED STATES PATENT AND TRADEMARK OFFICE

CERTIFICATE OF CORRECTION

PATENT NO. : 5,147,273

DATED : September 15, 1992

INVENTOR(S) : Engelbert Rottmann et al.

It is certified that error appears in the above-identified patent and that said Letters Patent is hereby corrected as shown below: On the Title page, items Please replace the information pertaining to [73] Assignee as follows: --Winkler & Duennebier Maschinenfabrik und Eisengiesserei KG, Neuwied, Federal Republic of Germany--. Above [57] ABSTRACT please insert --Attorney, Agent or Firm - W. G. Fasse--.

Signed and Sealed this

Ninth Day of November, 1993

Bruce Lehman

*Attest:*

BRUCE LEHMAN

*Attesting Officer*

*Commissioner of Patents and Trademarks*